US011152709B2

(12) United States Patent
Leung et al.

(10) Patent No.: US 11,152,709 B2
(45) Date of Patent: Oct. 19, 2021

(54) ANTENNA ASSEMBLY

(71) Applicant: City University of Hong Kong, Kowloon (HK)

(72) Inventors: Kwok Wa Leung, Kowloon Tong (HK); Lei Guo, Kowloon Tong (HK); Kim Fung Tsang, Kowloon Tong (HK)

(73) Assignee: City University of Hong Kong, Kowloon (HK)

( * ) Notice: Subject to any disclaimer, the term of this patent is extended or adjusted under 35 U.S.C. 154(b) by 306 days.

(21) Appl. No.: 16/174,668

(22) Filed: Oct. 30, 2018

(65) Prior Publication Data

US 2019/0379126 A1 Dec. 12, 2019

Related U.S. Application Data

(63) Continuation-in-part of application No. 16/003,167, filed on Jun. 8, 2018.

(51) Int. Cl.

| | |
|---|---|
| ***H01Q 13/10*** | (2006.01) |
| ***H01Q 13/24*** | (2006.01) |
| ***H01Q 9/04*** | (2006.01) |
| ***H01Q 1/12*** | (2006.01) |

(52) U.S. Cl.

CPC ..... *H01Q 13/106* (2013.01); *H01Q 1/1221* (2013.01); *H01Q 9/0485* (2013.01); *H01Q 13/24* (2013.01)

(58) Field of Classification Search

CPC ..... H01Q 1/1221; H01Q 9/0485; H01Q 1/46

See application file for complete search history.

(56) References Cited

U.S. PATENT DOCUMENTS

| | | | | |
|---|---|---|---|---|
| 6,836,402 | B1 | 12/2004 | Huang | |
| 9,123,995 | B2 | 9/2015 | Leung | |
| 2009/0153403 | A1* | 6/2009 | Chang | H01Q 9/0492 343/700 MS |
| 2013/0164971 | A1 | 6/2013 | Chung et al. | |
| 2013/0249757 | A1* | 9/2013 | Leung | H01Q 9/0485 343/785 |
| 2015/0349427 | A1* | 12/2015 | Camden | H04L 12/282 343/702 |
| 2017/0033602 | A1 | 2/2017 | Zhang et al. | |

* cited by examiner

*Primary Examiner* — Andrea Lindgren Baltzell
*Assistant Examiner* — Amal Patel
(74) *Attorney, Agent, or Firm* — Renner, Kenner, Greive, Bobak, Taylor & Weber

(57) ABSTRACT

An antenna assembly, a wireless-communication-enabled device and an intelligent home or office appliance including such antenna assembly. The antenna assembly includes an antenna including an antenna body and a feeder, and at least one functional module arranged to operate with a function different from that provided by the antenna; wherein the at least one functional module includes at least one electrical connection module arranged to connects with an external electrical connector.

26 Claims, 20 Drawing Sheets

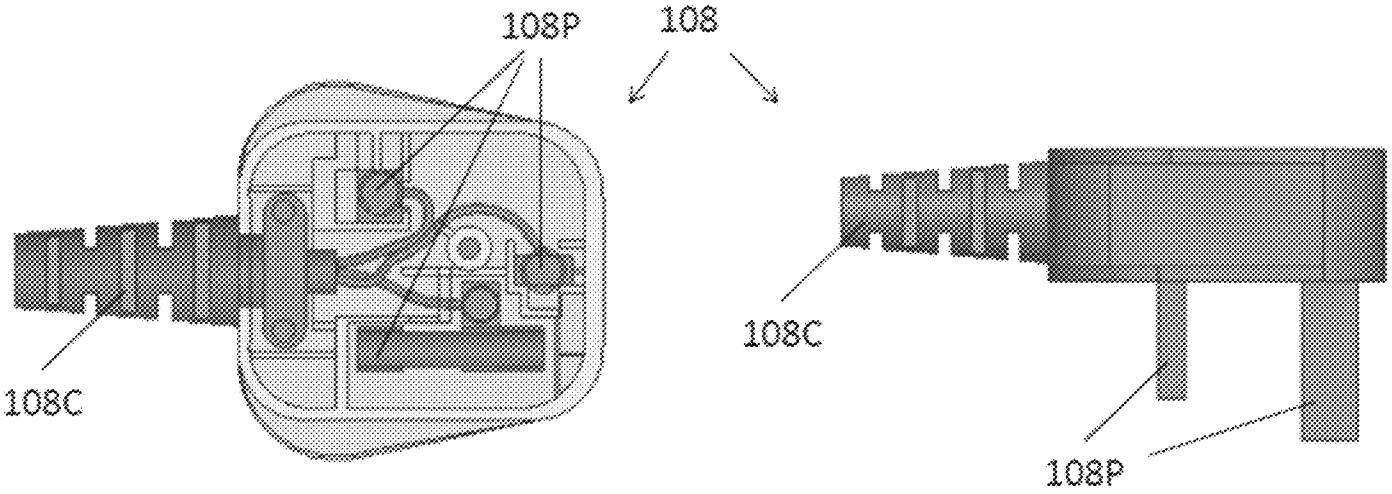
FIG. 2A
FIG. 2B
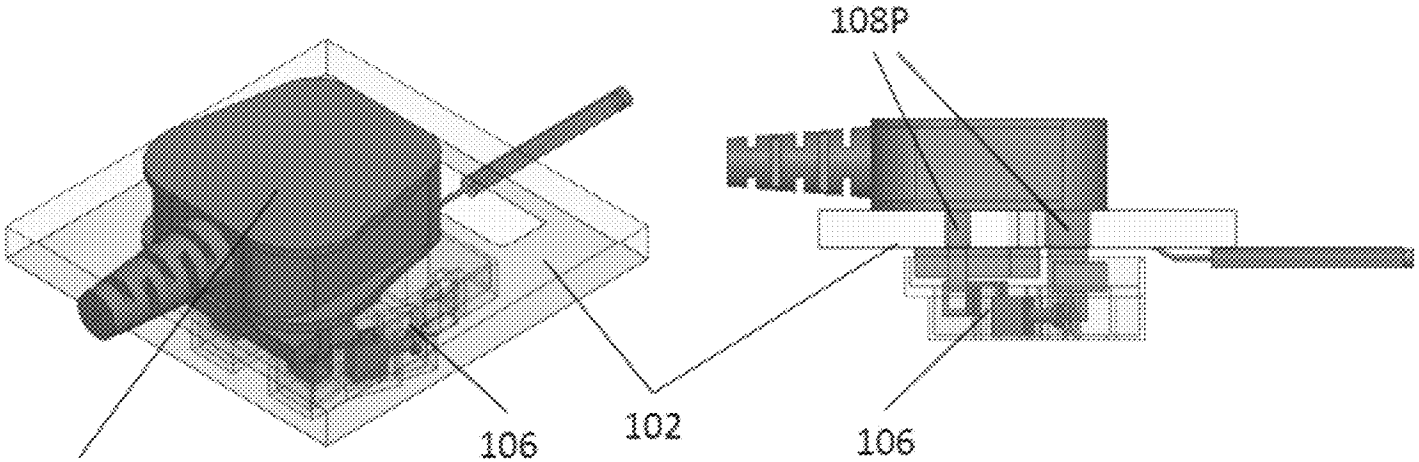
FIG. 3A
FIG. 3B

Simulation socket panel with plug at 2.4 GHz

Measurement socket panel with plug at 2.4 GHz

Measurement socket panel with plug and cable at 2.4 GHz

ANTENNA ASSEMBLY

TECHNICAL FIELD

The present invention relates to an antenna assembly, and particularly, although not exclusively, to a multifunctional antenna assembly.

BACKGROUND

In a radio signal communication system, information is transformed to radio signal for transmitting in form of an electromagnetic wave or radiation. These electromagnetic signals are further transmitted and/or received by suitable antennas.

Some antennas may be designed to be housed within a casing of an electrical apparatus so as to provide a better appearance of such apparatus, however the performance of these built-in antennas may be degraded by an unavoidable shielding effect induced by the housing encapsulating the antennas and the internal components of the apparatus.

SUMMARY OF THE INVENTION

In accordance with a first aspect of the present invention, there is provided an antenna assembly comprising an antenna including an antenna body and a feeder, and at least one functional module arranged to operate with a function different from that provided by the antenna; wherein the at least one functional module includes at least one electrical connection module arranged to connects with an external electrical connector.

In an embodiment of the first aspect, the antenna body includes a dielectric resonator.

In an embodiment of the first aspect, the antenna is a dielectric resonator loaded slot antenna.

In an embodiment of the first aspect, the antenna is arranged to radiate an electromagnetic radiation including at least one of a broadside, an endfire, an omnidirectional and a conical-beam radiation pattern.

In an embodiment of the first aspect, the antenna includes a non-resonant-type antenna.

In an embodiment of the first aspect, the functional module is physically connected to the antenna body.

In an embodiment of the first aspect, the dielectric resonator is provided with at least one mounting structure arranged to mount the functional module thereon.

In an embodiment of the first aspect, the mounting structure is further arranged to at least partially accommodate or encompass the functional module.

In an embodiment of the first aspect, the mounting structure includes an aperture defined in the dielectric resonator.

In an embodiment of the first aspect, the dielectric resonator is a rectangular block of dielectric material.

In an embodiment of the first aspect, the dielectric material includes at least one of zirconia, silicon dioxide, acrylic and porcelain.

In an embodiment of the first aspect, the antenna body is at least partially transparent.

In an embodiment of the first aspect, the feeder includes a slot feeder.

In an embodiment of the first aspect, the slot feeder comprises a feeding slot structure defined on the antenna body.

In an embodiment of the first aspect, the feeding slot structure is defined in a positioned shifted from a center position of the antenna body.

In an embodiment of the first aspect, the slot feeder further comprises a microstripline or coaxial feedline adjacent to the feeding slot structure.

In an embodiment of the first aspect, the feeder includes at least one of a probe feed, a direct microstrip feedline, a coplanar feed, a dielectric image guide, a metallic waveguides and a substrate-integrated waveguide.

In an embodiment of the first aspect, the antenna further comprises a ground plane adjacent to the antenna body.

In an embodiment of the first aspect, the ground plane includes an electrical conductive sheet connected to the antenna body.

In an embodiment of the first aspect, the electrical conductive sheet includes a sheet of copper adhesive.

In an embodiment of the first aspect, the at least one electrical connection module comprises an electrical power socket.

In an embodiment of the first aspect, the external electrical connector includes an electrical plug.

In an embodiment of the first aspect, the antenna assembly is arranged to operate as an electrical socket panel.

In an embodiment of the first aspect, the functional module comprises an electrical switch.

In an embodiment of the first aspect, the antenna assembly is arranged to operate as an electrical switch-socket panel.

In an embodiment of the first aspect, the antenna body is arranged to form a part of an electrical apparatus.

In an embodiment of the first aspect, the electrical apparatus includes an intelligent home or office appliance.

In an embodiment of the first aspect, the electrical apparatus includes a wireless-communication-enabled device.

In accordance with a second aspect of the present invention, there is provided a wireless-communication-enabled device, comprising an antenna assembly in accordance with the first aspect, wherein the antenna is arranged to facilitate a communication between an external communication device and the wireless-communication-enabled device.

In accordance with a third aspect of the present invention, there is provided an intelligent home or office appliance, comprising the wireless-communication-enabled device in accordance with the second aspect or the antenna assembly in accordance with the first aspect.

BRIEF DESCRIPTION OF THE DRAWINGS

Embodiments of the present invention will now be described, by way of example, with reference to the accompanying drawings in which:

FIGS. 2A and 2B are a top view showing internal connections and a side view of an electrical connector compatible with the electrical connection module of the antenna assembly of FIG. 1A;

FIGS. 3A and 3B are a perspective view and a side view showing a combination of the electrical connector of FIG. 2A and the antenna assembly of FIG. 1A;

DETAILED DESCRIPTION OF THE PREFERRED EMBODIMENT

The inventors have, through their own research, trials and experiments, devised that transparent antenna may be used in multifunctional element in automobiles or aircrafts, solar module, and mirror. In some example embodiments, the antennas may include planar structures using different transparent conductive materials, such as transparent conducting oxide (TCO) films, indium tin oxide (ITO), fluorine-doped tin oxide (FTC)), and silver coated polyester (AgHT). However, a compromise should be made in these transparent conducting materials between the transparency and the ohmic loss.

Alternatively, a 3-D transparent glass dielectric resonator (DR) antenna (DRA) may be used instead. The DRA may inherit a number of advantages such as compact size, low loss, high efficiency, and high degree of design flexibility. In one example embodiment, a transparent DRA may be made of K9 glass with a dielectric constant around 7 from 0.5 GHz to 3 GHz. Using the glass block, the gain and efficiency of the transparent antenna may be comparable with some typical designs of DRA. The transparent glass DRA may also be bundled with several functions for compactness, such as a focusing lens and protective cover (or encapsulations) for solar panels.

In some other embodiments, the transparent glass DRAs may also be used as a decoration, a light cover, and even a mirror.

Figure 1A:
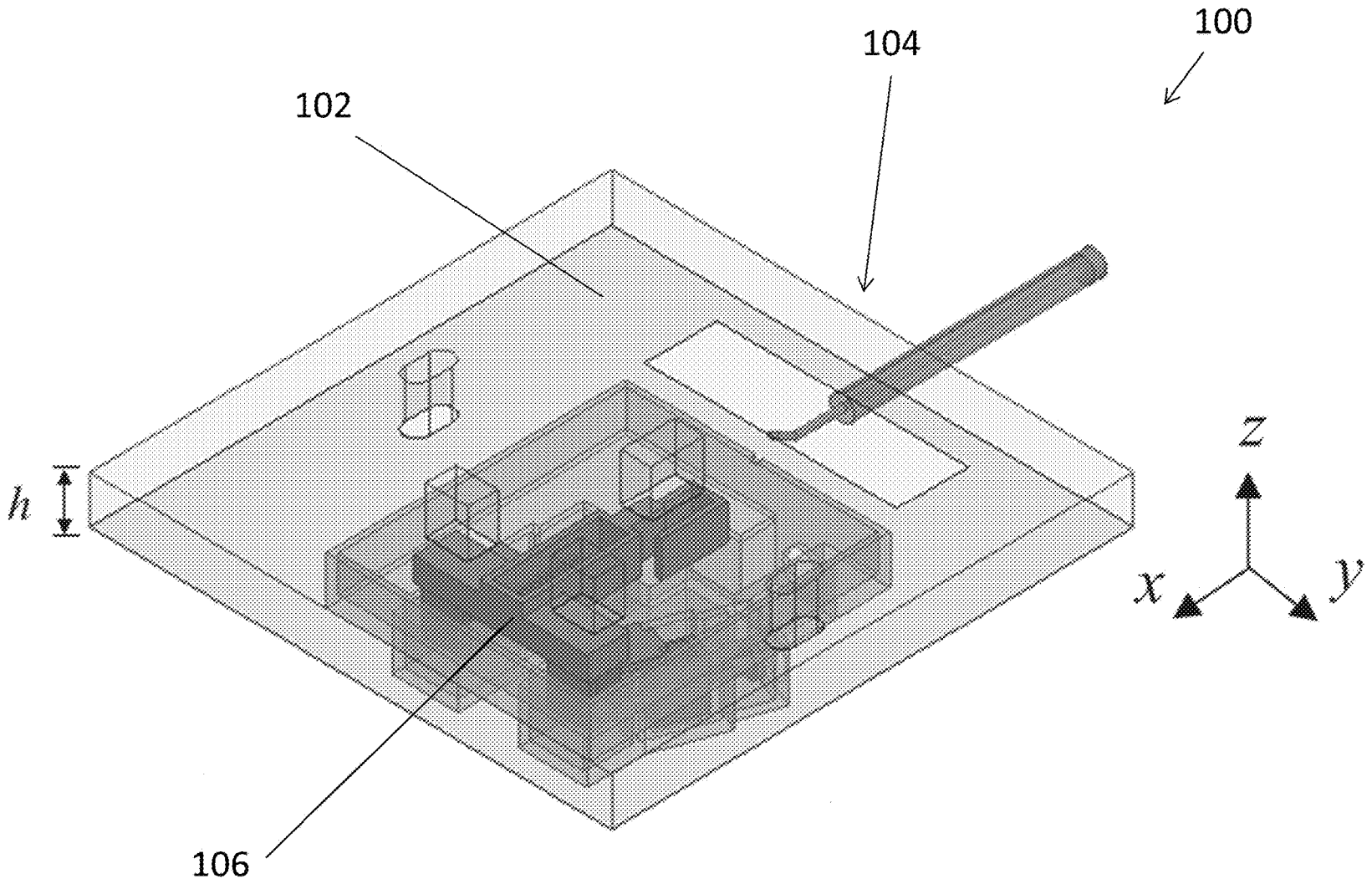
FIGS. 1A, 1B and 1C are a perspective view, a top view and a bottom view of an antenna assembly in accordance with one embodiment of the present invention.
Figure 1C:
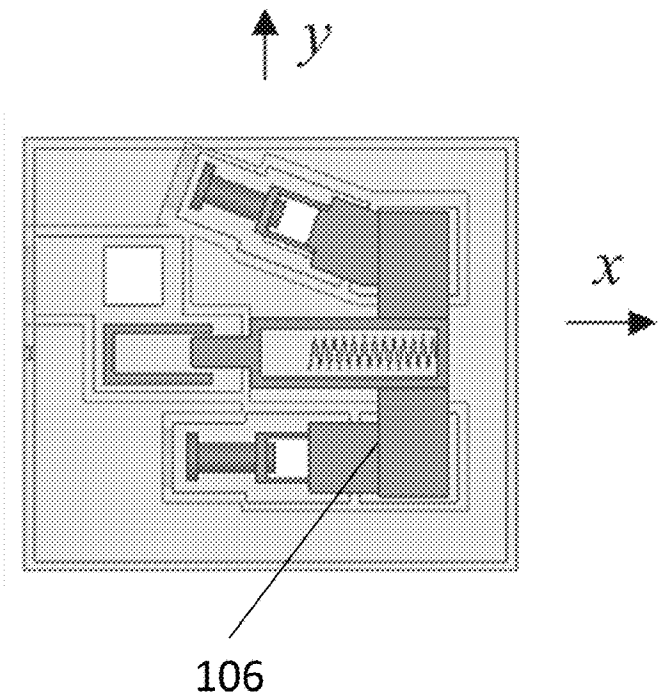
Figure 1B:
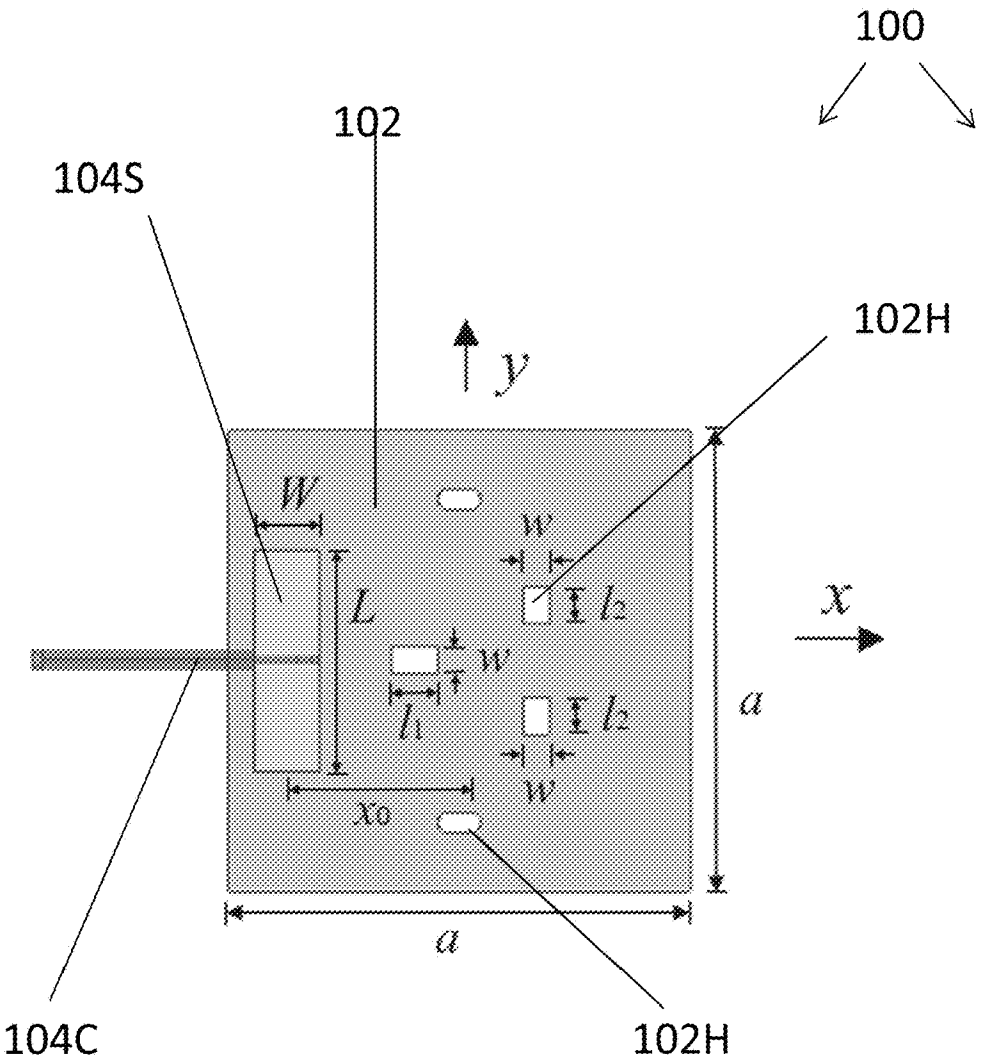

With reference to FIGS. 1A and 1B, there is shown an example embodiment of an antenna assembly 100 comprising an antenna including an antenna body 102 and a feeder 104, and at least one functional module 106 arranged to operate with a function different from that provided by the antenna; wherein the at least one functional module 106 includes at least one electrical connection module arranged to connects with an external electrical connector 108.

In this embodiment, the antenna assembly 100 includes an antenna and an electrical power socket 106 combined as an assembly, and may be used as an electrical socket panel, such as a socket panel which may be installed on a wall surface for supplying electrical power to an electrical apparatus in a room. The physical dimension of the socket panel 100 in this example may match with a typical socket panel, such that the antenna assembly 100 may retrofit existing structures therefore the installed socket panel may be conveniently replaced by the antenna assembly 100. By replacing the existing socket panel with the antenna assembly 100 in accordance with embodiments of the present invention, wireless communication function may be introduced to the environment without substantially modifying the existing infrastructure.

Preferably, the antenna body 102 includes a dielectric resonator (DR), and therefore the antenna may be provided as a dielectric resonator antenna (DRA) or a dielectric resonator loaded slot antenna. Preferably, the dielectric resonator 102 is provided as block of rigid material with certain volume and dimensions, which may also serve as a mechanical support for the functional module 106 of the antenna assembly 100 when the functional module 106 is physically connected to the antenna body 102 or the DR.

Preferably, the dielectric resonator 102 may also be provided with at least one mounting structure, such as an aperture, a cavity, or any suitable fastening structure, arranged to mount the functional module 106 thereon. The mounting structure may be used to accommodate or encompass at least a portion of the function module 106. Alternatively, the functional module 106 may be connected to the DR 102 via external fastening means or an engagement between mechanical structures provided on the functional module 106 and the fasten structure provided on the antenna body 102.

In this example, the functional module 106 includes at least an electrical connection module, such as an electrical power socket, arranged to connect with an external electrical connector 108. With reference also to FIGS. 2A and 2B, the external electrical connecter 108 may be an IEC (International Electrotechnical Commission) type-G electrical plug including three rectangular shaped electrical pins 108P. The configuration and dimension of the pins 108P match with the respective apertures 102H and electrical leads in the electrical power socket 106 of the antenna assembly 100, such that the plug 108 and the socket 106 are securely held together when the electrical pins 108P are inserted in their respective proper positions in the socket 106, referring to FIGS. 3A and 3B.

In some alternative embodiments, the electrical power socket 106 of the antenna assembly 100 may include configurations of other types of power plug, including but not limited to other 2- or 3-pin plugs according to the standard.

In addition, the antenna assembly 100 may comprises two or more electrical connection modules 106 for connecting more number of plugs of the same or different types. Yet alternatively, other types of functional modules 106 may be included in the same antenna assembly 100.

Referring to FIGS. 1A and 1B, there is shown an example configuration of the antenna assembly 100 or the dual-function socket antenna in accordance with an embodiment of the present invention.

The dielectric resonator 102 is a rectangular block of dielectric material, such as K9 glass with a dielectric constant of 6.85. Its height and side length are designed as h=8 mm, and a=87 mm, respectively.

Alternatively, the dielectric material includes other types of material, such as but not limited to silicon dioxide, acrylic and porcelain, or any material which is at least partially transparent. Alternatively, non-transparent DR material may be used in some other example embodiments.

With reference to FIGS. 1A to 1C, the antenna body 102 is further defined with a plurality of apertures 102H for different purposes. Theses apertures may be included for mounting the antenna assembly 100 on an external structure such as mounting brackets via additional fastening means such as screws, or for penetrations of the electrical pins 108P of the external connector 108 from a front (top) surface to a back (bottom) surface on the opposite side through the antenna body. In addition, for slot antenna excitation, one or more slots 104S (apertures in an elongated shape) may be defined on the antenna body 102.

The antenna assembly 100 further comprises a ground plane adjacent to the antenna body 102. The ground plane may be an electrical conductive sheet placed adjacent or connected to the antenna body 102. In one example embodiment, the ground plane may be provided by placing a sheet of adhesive copper tape on the bottom side of the antenna body 102. In this example, the ground plane includes a dimension which is substantially the same as the panel surface of the antenna body or the DR 102. In addition, similar apertures on the antenna body 102 are also provided on the ground plane at these positions such that screws or electrical pins may penetrate trough the antenna body 102 and the ground plane.

Referring to FIG. 1B, three through rectangular holes are drilled in both the panel and ground plane for placing the plug with dimensional parameters of $l_1$=9 mm, $l_2$=7 mm, and w=5 mm. Besides, two elliptical holes are reserved for screws in order to fix the panel into a specific object.

In order to excite the socket panel 100 or the DR 102, the antenna may be fed by a slot feeder 104. For example, a rectangular aperture 104S is cut on the ground plane as a slot antenna, with dimensional parameters of L=42 mm and W=12 mm. By making use of the dielectric resonator loading effects of the socket, effective radiation can be achieved through the slot. In order to reduce the influence of plug on slot radiation, the feeding slot structure is defined in a positioned shifted from a center position of the antenna body. Referring to FIGS. 1A to 1C, the slot is designed off the panel center with a distance of $x_0$=32.5 mm.

The slot 104S is fed by a coaxial cable 104C placed in the center of the slot 104S. Alternatively, the slot feeder 104 may comprise a microstripline or coaxial feedline adjacent to the feeding slot structure, or the feeder 104 may include other types of feeder, such as but not limited to a probe feed, a direct microstrip feedline, a coplanar feed, a dielectric image guide, a metallic waveguides and a substrate-integrated waveguide.

In addition, the antenna assembly 100 is designed according to other typical socket panel.

In some alternative embodiments, the functional module 106 includes an electrical power switch, such switch panel may also operate as a wireless component of an electrical appliance. The antenna body 102 may alternatively form a part of an electrical apparatus including a wireless-communication-enabled device, for example the antenna body 102 may form a part of the housing of a wireless router, which may also operate as an antenna for radiating WiFi signal to facilitate a communication between an external communication device and the router.

The antenna assembly may also include multiple functional modules 106 of different types, such as an electrical power socket as well as an electrical switch, the switch may be provided for selectively closing the electrical connections between the electrical pins 108P and the socket 106, such that the antenna assembly 100 may operate as an electrical switch-socket panel. The switch-socket panel configuration may be provided electrical appliances which allow a temporary electrical disconnection at the socket on the apparatus ends, without having to unplug the cable from the electrical appliances.

The inventors have carried out parametric studies to investigate the operating mode of the antenna assembly 100 or the socket antenna in accordance with an embodiment of the present invention.

Figure 4A:
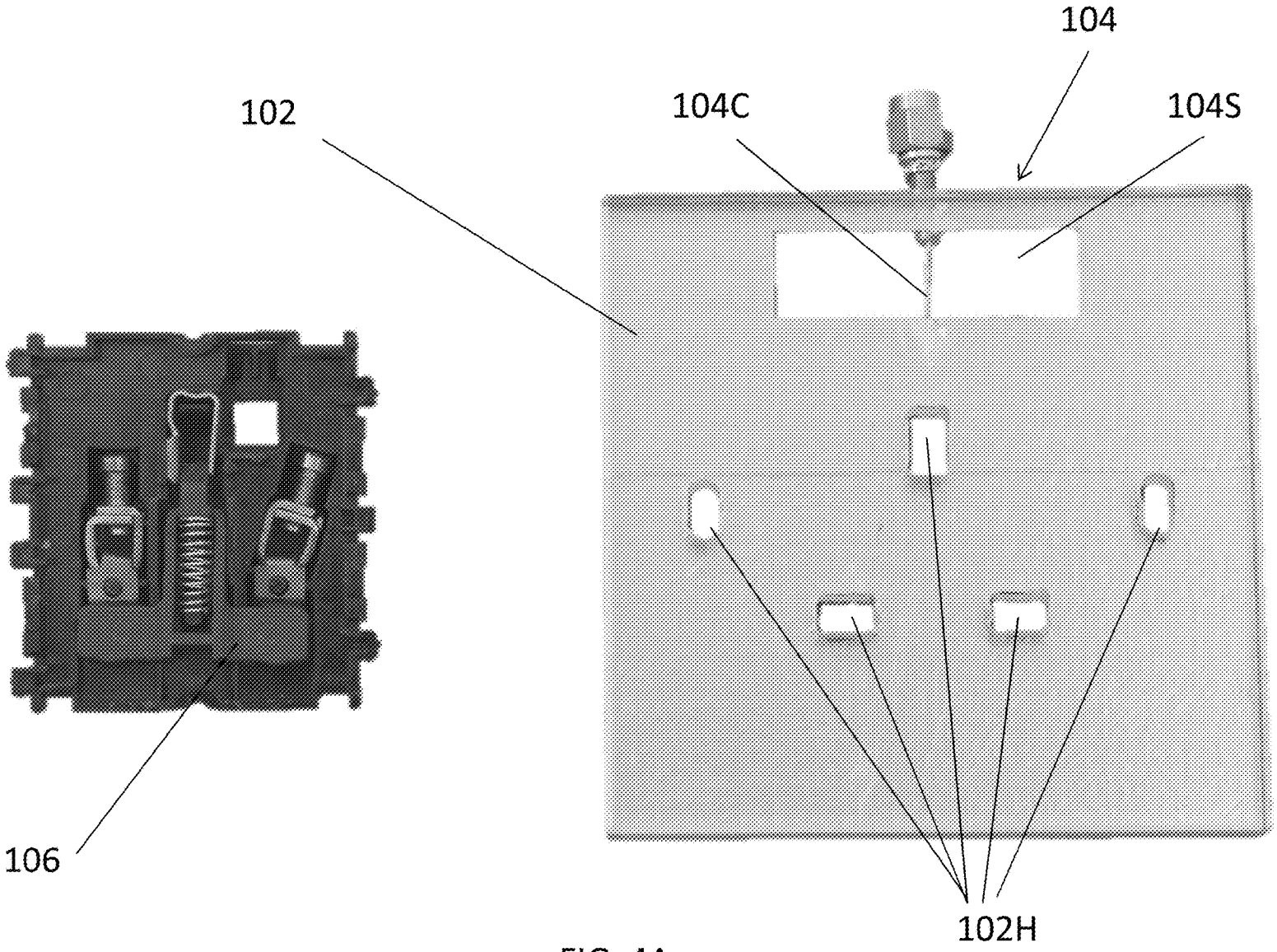
FIGS. 4A and 4B are photographic images showing an exploded view and a side view of a fabricated antenna assembly of FIG. 1A.
Figure 4B:
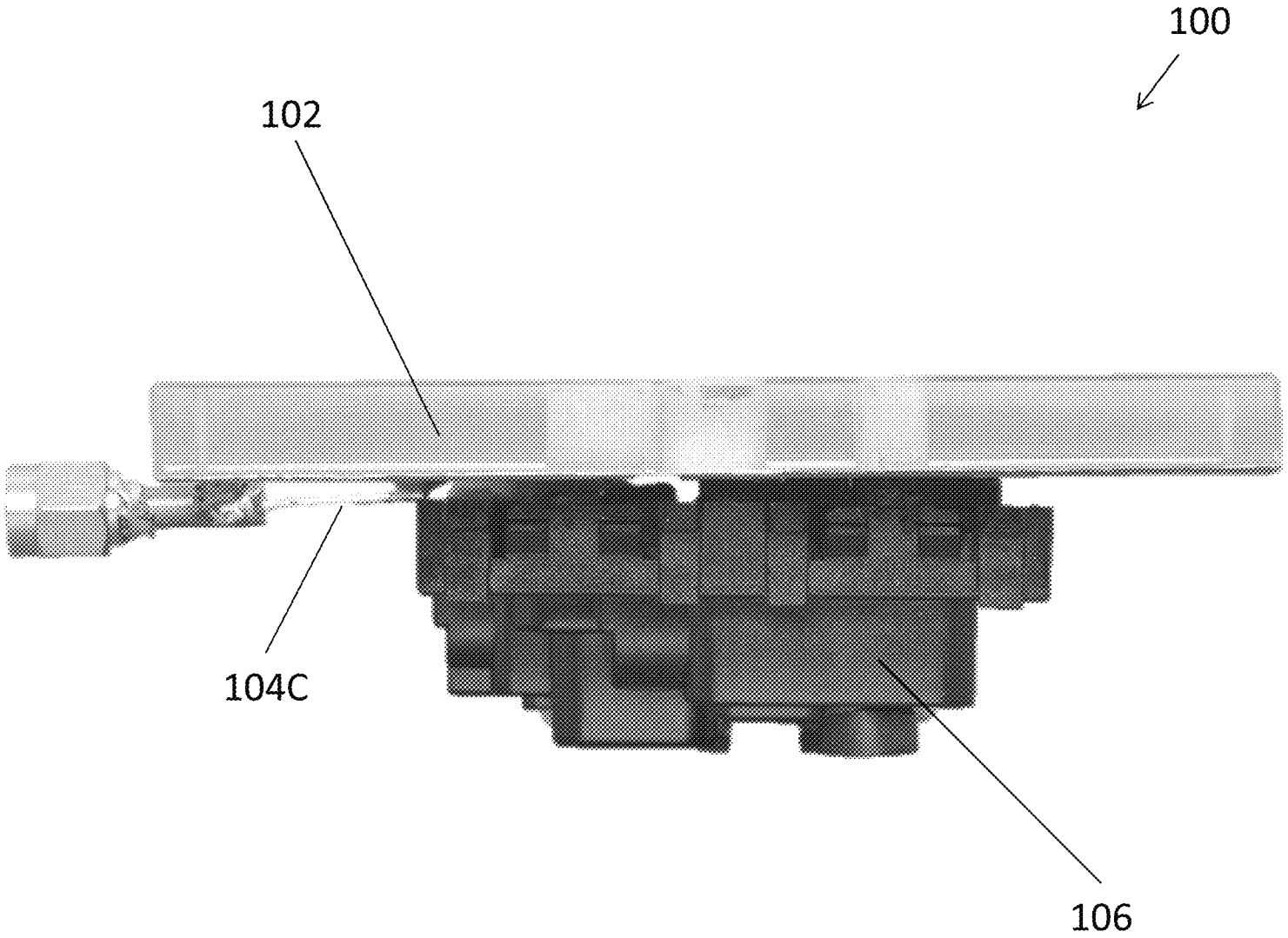

With reference to FIGS. 4A and 4B, a socket antenna 100 was fabricated in accordance with an embodiment of the present invention, and the performance of the antenna assembly 100 was analysed and compared with the simulation results.

To show the effects of the power supply box or the electrical power socket located behind the panel, two cases are investigated and compared: socket panel and panel (socket panel without power supply box).

Figure 5:
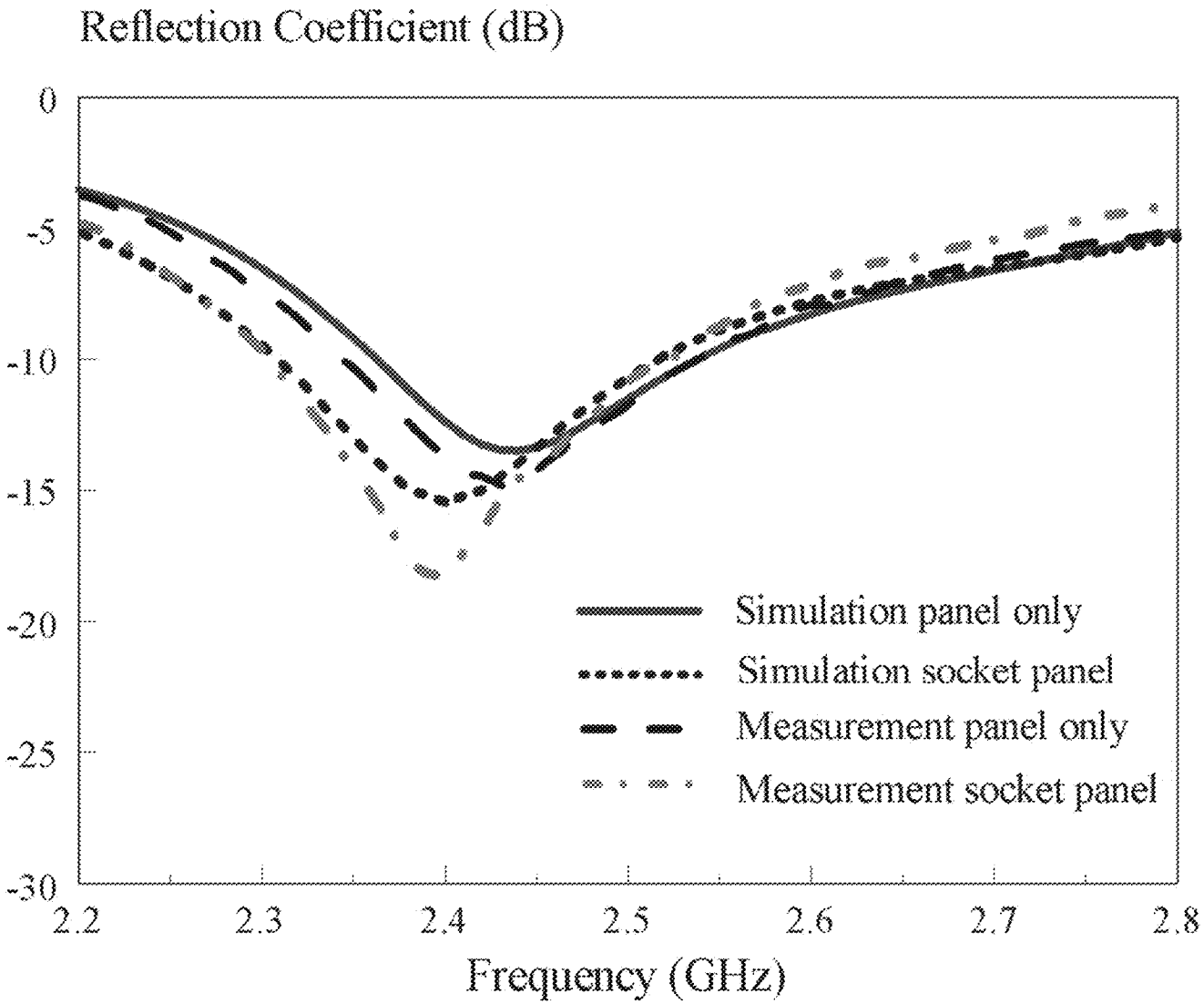
FIG. 5 is a plot showing simulated and measured reflection coefficients of the antenna body and socket panel of the antenna assembly of FIG. 1A.
Figures 6A, 6B:
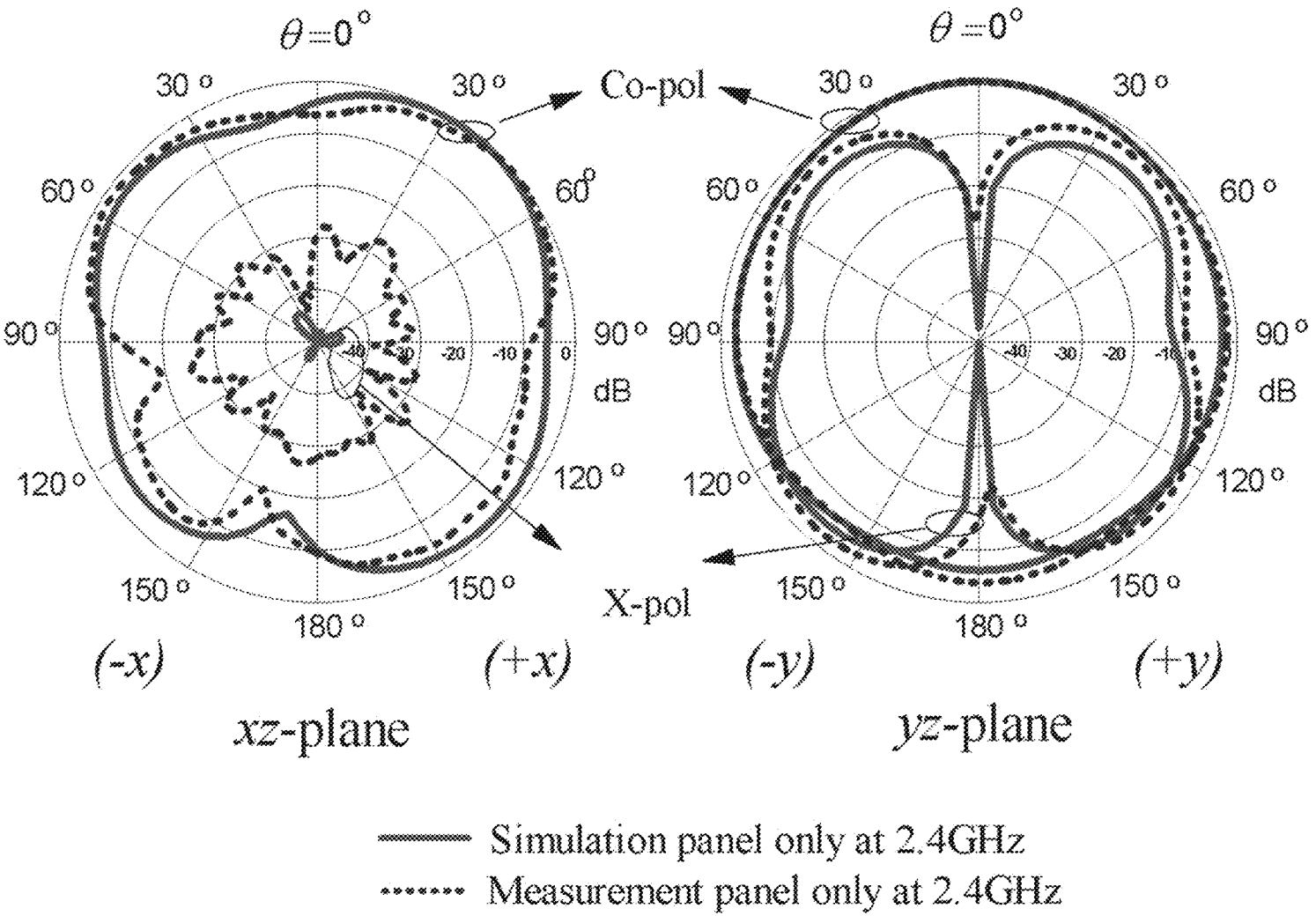
FIGS. 6A and 6B are plots showing simulated and measured radiation patterns of the antenna body of the antenna assembly of FIG. 1A, in an elevation (xz-) plane of the panel and an elevation (yz-) plane of the panel respectively.
Figures 6C, 6D:
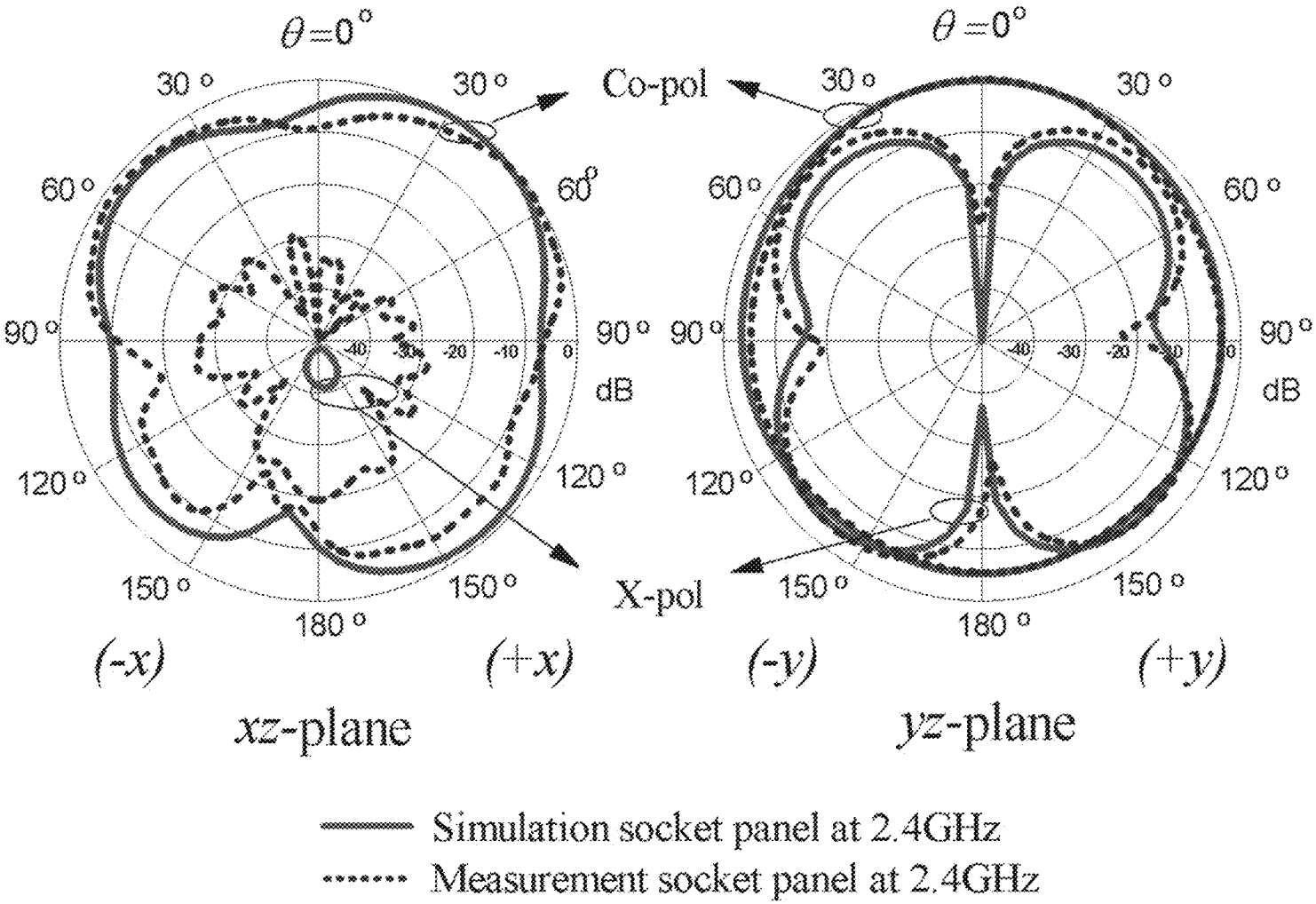
FIGS. 6C and 6D are plots showing simulated and measured radiation patterns of the antenna assembly of FIG. 1A, in an elevation (xz-) plane of the panel and an elevation (yz-) plane of the panel respectively.

With reference to FIG. 5, there is shown experimental results of the simulated and measured reflection coefficients of the antenna body of the antenna assembly 100. Both the simulated and measured resonant frequencies are 2.44 GHz. The measured impedance bandwidth ($|S_{11}| \leq -10$ dB) is 7.8% (2.35-2.54 GHz), reasonably agreeing with the simulated counterpart of 6.5% (2.37-2.53 GHz). Both the simulated and measured impedance bandwidths can cover the designed 2.4 GHz-WLAN band (3.3%).

The socket antenna 100 is further evaluated by placing the power supply box behind the panel as shown in FIG. 4B. The power supply box used in the measurement is dissembled directly from a socket panel. The simulated and measured reflection coefficients are also provided in FIG. 5 for comparison. Again, reasonable agreement is observed between the simulated and measured results. Referring to the figure, the socket panel resonates at 2.4 GHz in both the simulation and the measurement. The simulated and measured impedance bandwidths are 8.3% (2.31-2.51 GHz) and 8.7% (2.31-2.52 GHz), respectively. In addition, it is observed that the power supply box has no virtual influence on the reflection coefficient.

With reference to FIGS. 6A to 6D, the plots illustrate the simulated and measured radiation patterns of the antenna body (hereinafter "the panel") and the antenna assembly 100 (hereinafter "socket panel") at 2.4 GHz. The measured results reasonably agree with the simulated ones in both cases. The asymmetry of radiation patterns in the xz-plane results from the asymmetric position of the slot. It can also be seen that the power supply box has neglectable effect on the radiation patterns, as both cases have quite similar patterns. The two cases have same simulated and measured maximum gain directions that locate at $\phi=0°$, $\theta=35°$ and $\phi=0°$, $\theta=49°$, respectively. The difference between the simulation and measurement could be due to the experiment imperfection Preferably, the antenna is arranged to radiate an electromagnetic radiation of other forms, such as but not limited to a broadside, an endfire, an omnidirectional and a conical-beam radiation pattern. The antenna may operate as a resonant-type or a non-resonant-type antenna.

Figure 7:
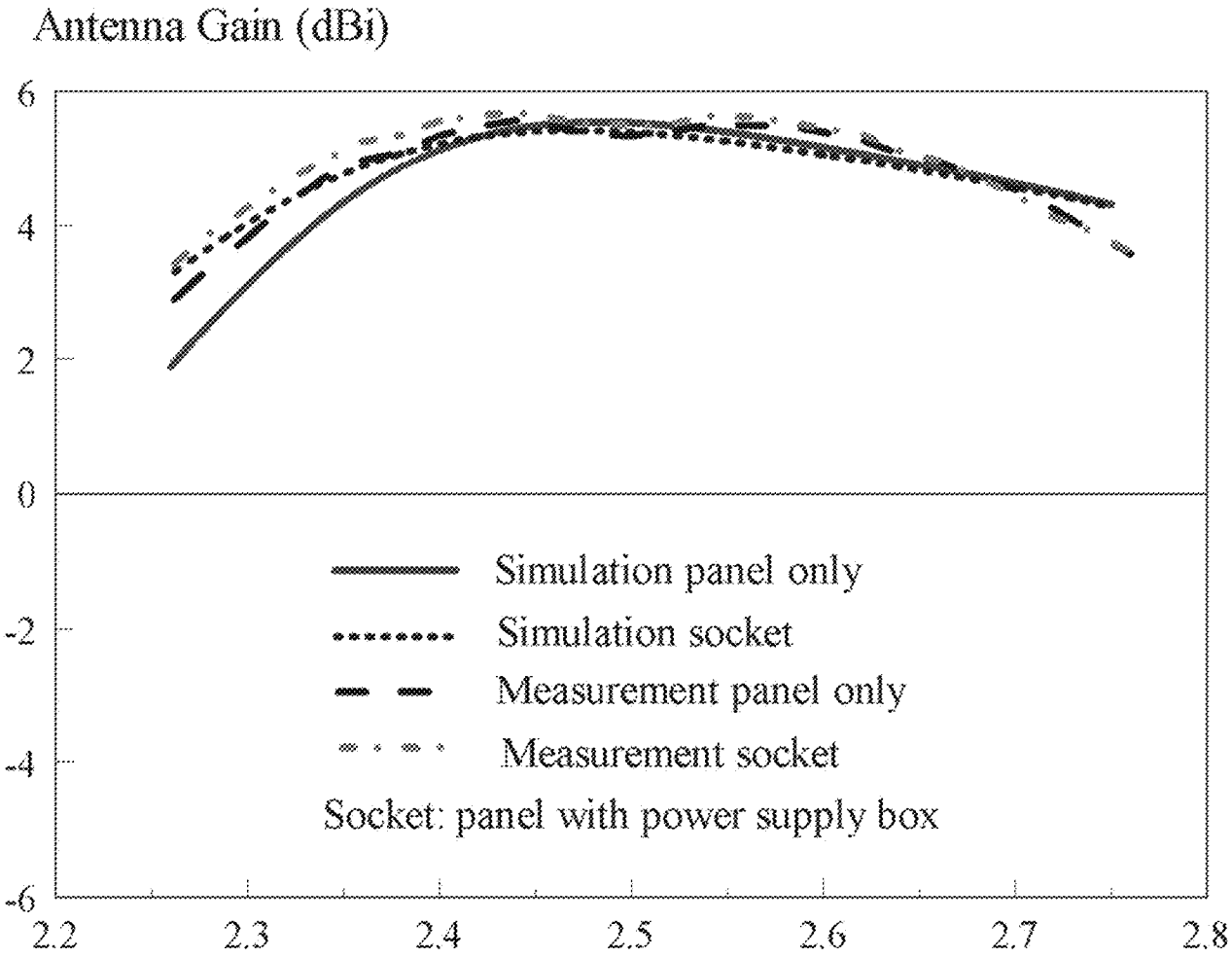
FIG. 7 is a plot showing simulated ($\phi$=0°, $\theta$=35°) and measured ($\phi$=0°, $\theta$=49°) antenna gains of the antenna body and antenna assembly of FIG. 1A at maximum gain directions.

With reference to FIG. 7, there is an experimental result showing the simulated and measured gains of the panel against frequency at maximum gain directions of $\phi=0°$, $\theta=35°$ and $\phi=0°$, $\theta=49°$, respectively. Reasonable consistency is obtained between the simulated and measured results. Over the respective impedance passband, the panel has a simulated and measured maximum gain of 5.54 dBi and 5.55 dBi. The plot also shows the simulated and measured antenna gains of the socket panel at the same directions as those of panel. Again, reasonable consistency is observed. Maximum values of 5.42 dBi and 5.68 dBi are obtained across the simulated and measured impedance passbands, respectively. It may be observed that no significant difference is observed between the gain curves of the panel and socket panel across the designed frequency band. This is reasonable because the ground plane can block most interference from the region behind the panel.

Figure 8:
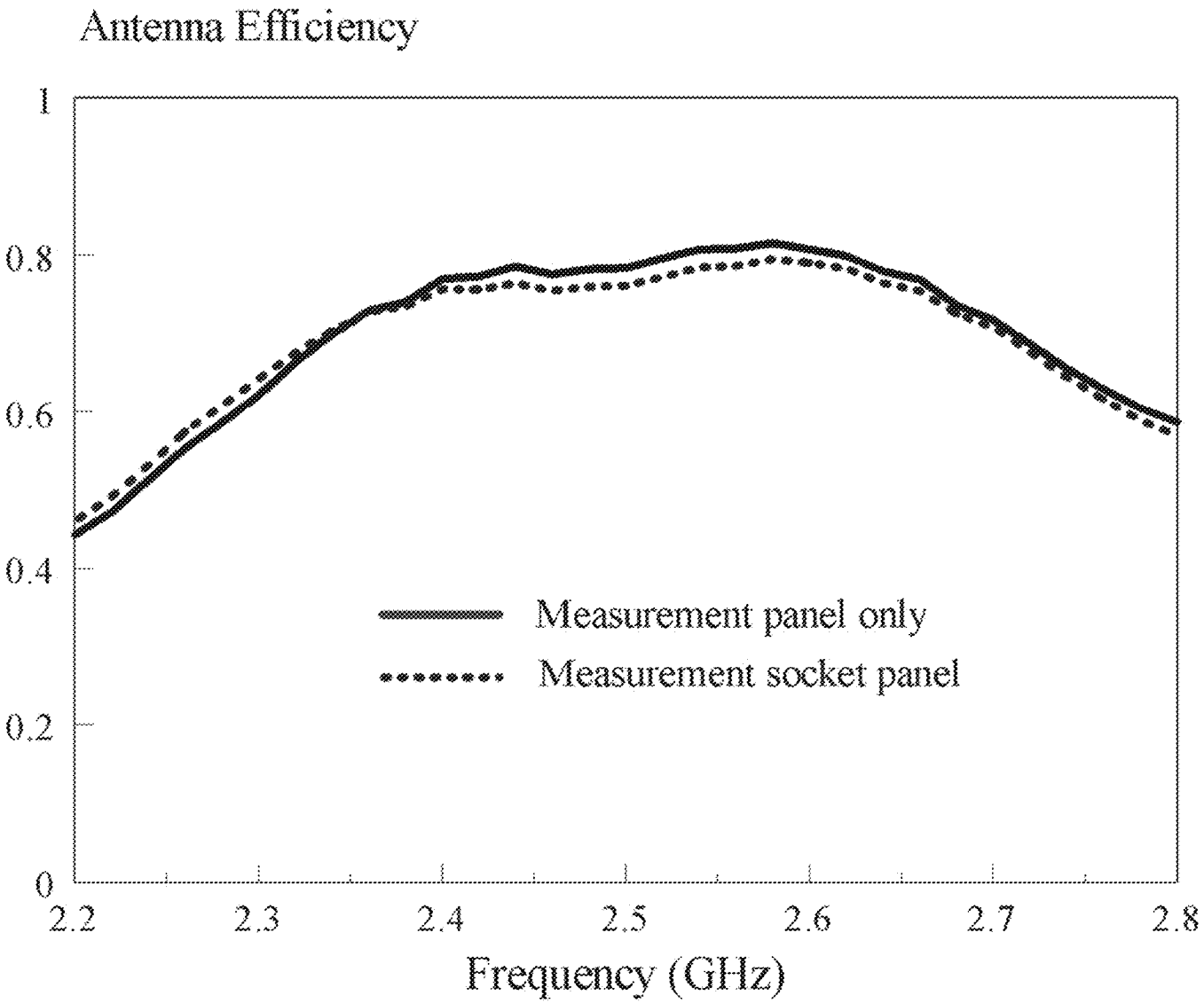
FIG. 8 is a plot showing measured antenna efficiencies of the antenna body and antenna assembly of FIG. 1A.
Figure 9A:
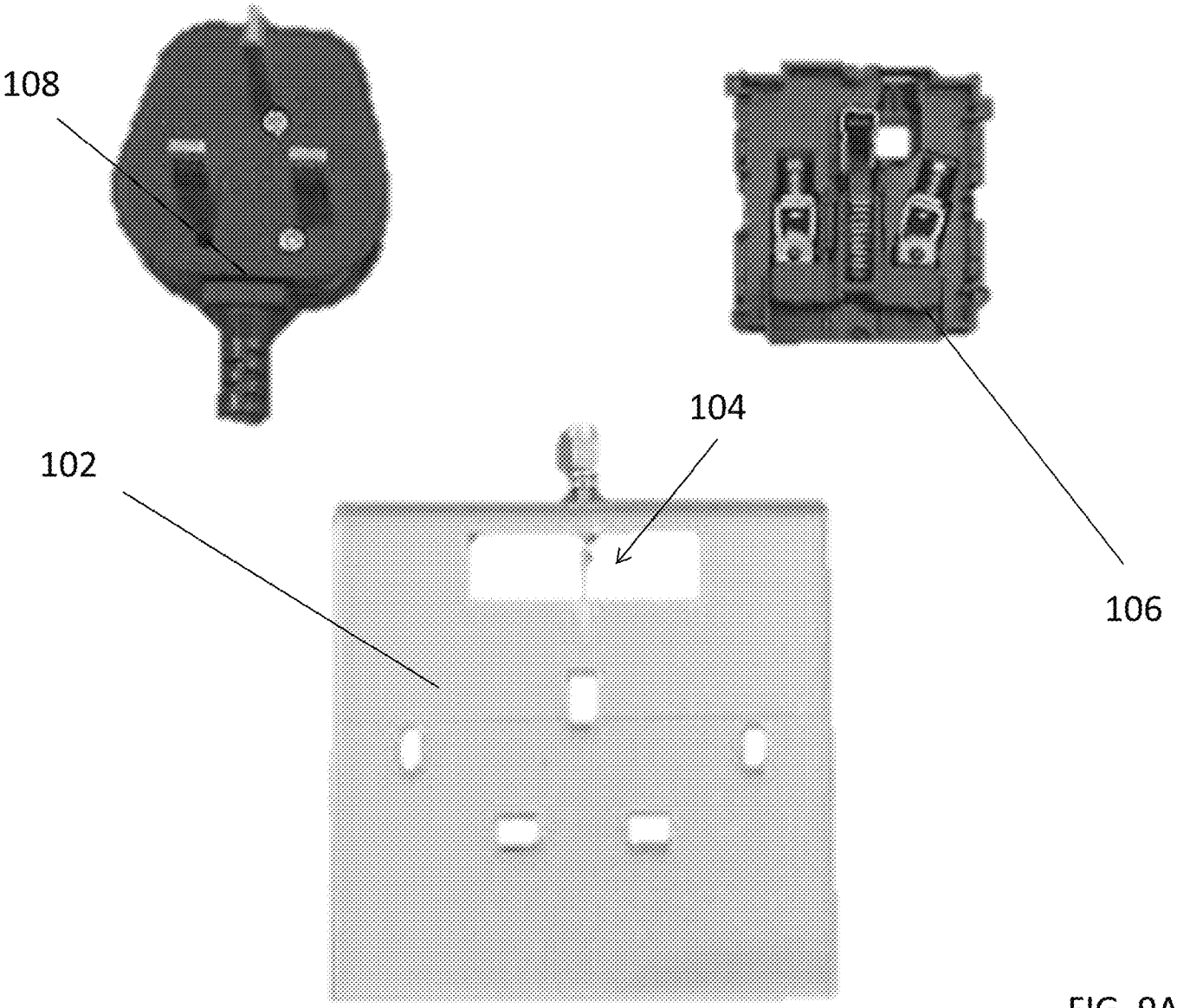
FIGS. 9A, 9B and 9C are photographic images showing an exploded view, a top view and a side view of the electrical connector and the antenna assembly of FIG. 3A.
Figures 9B, 9C:
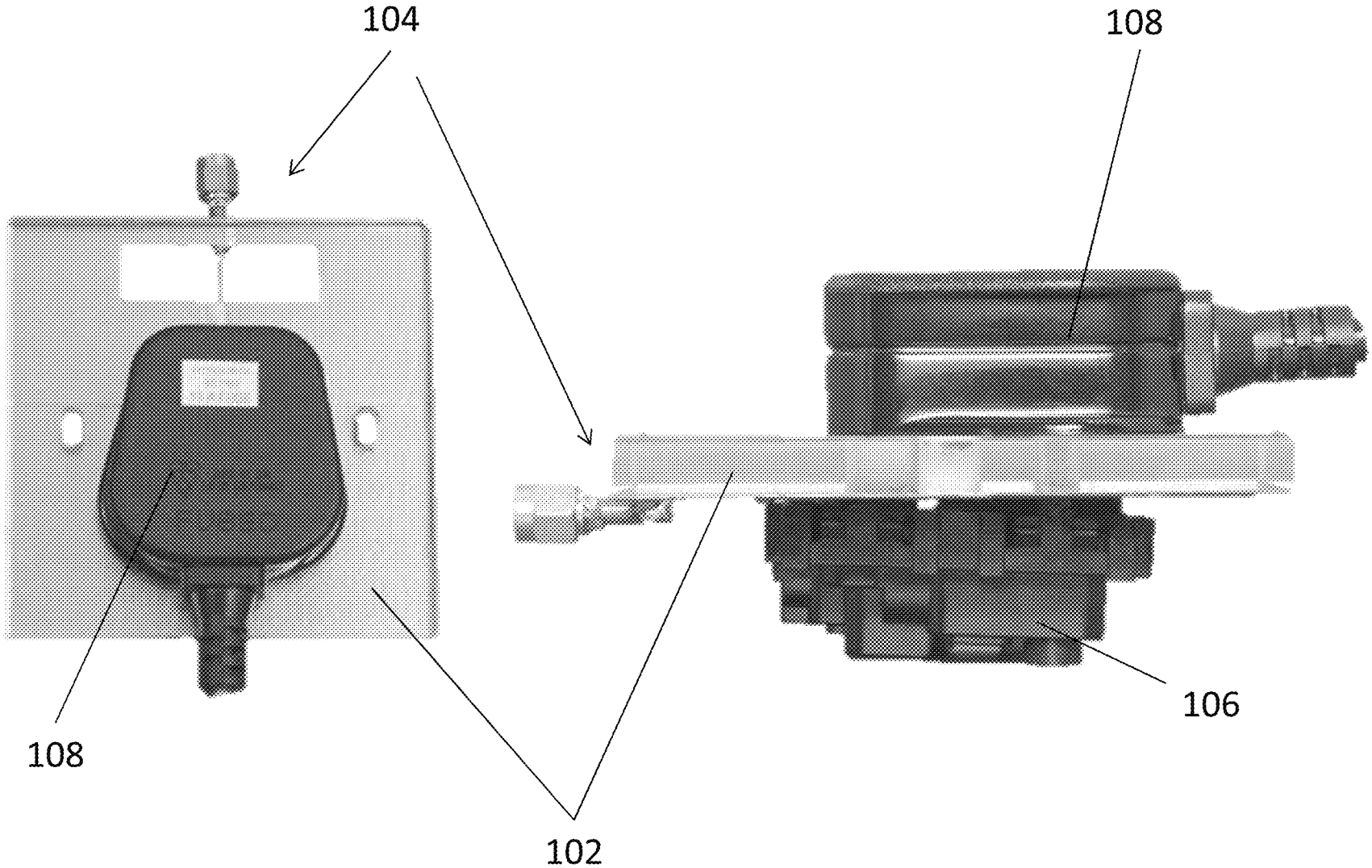
Figure 10A:
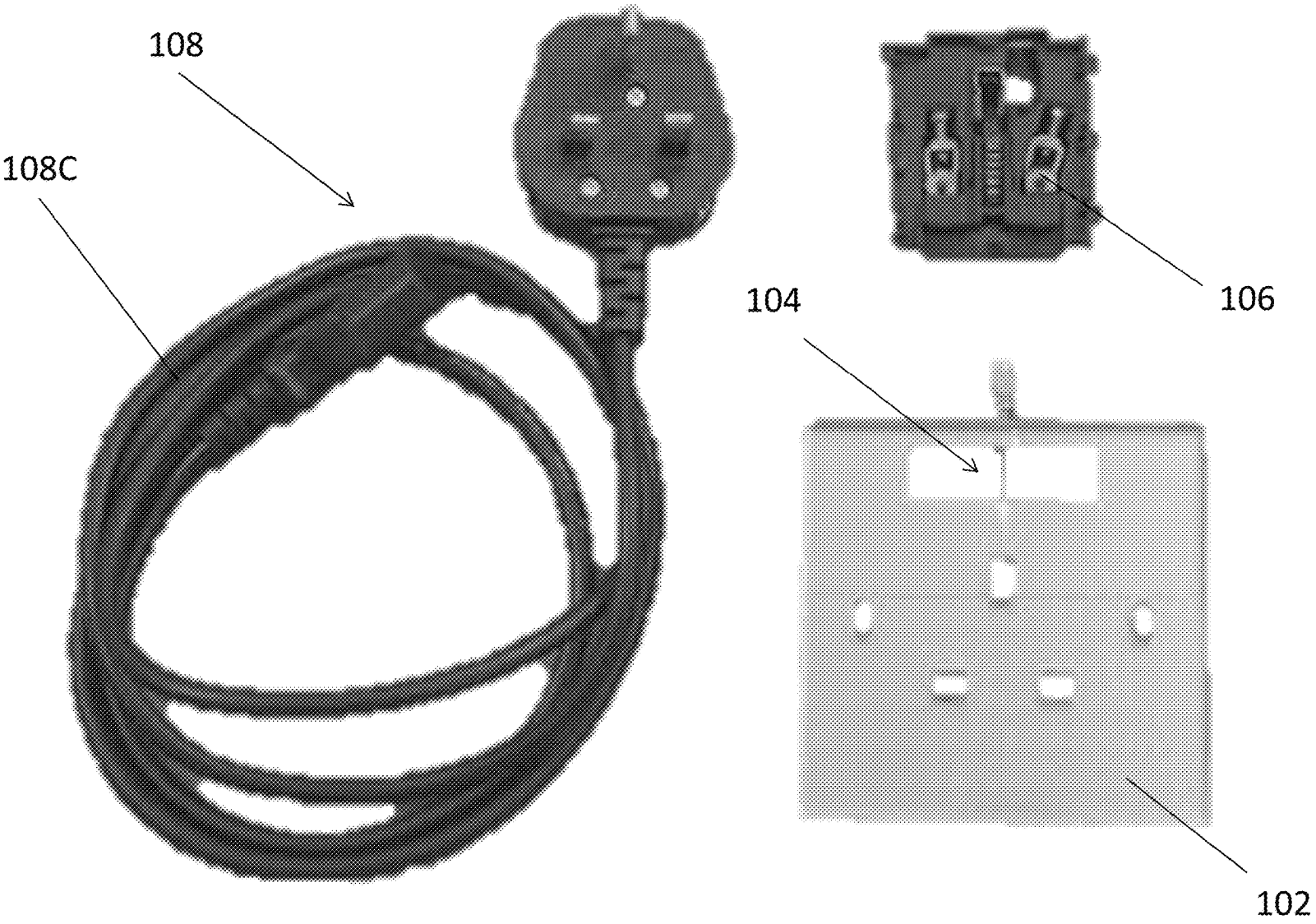
FIGS. 10A, 10B and 10C are photographic images showing an exploded view, a top view and a side view of the electrical connector and the antenna assembly of FIG. 9B, wherein the electrical connector is further connected to an electrical cable.
Figure 10B:
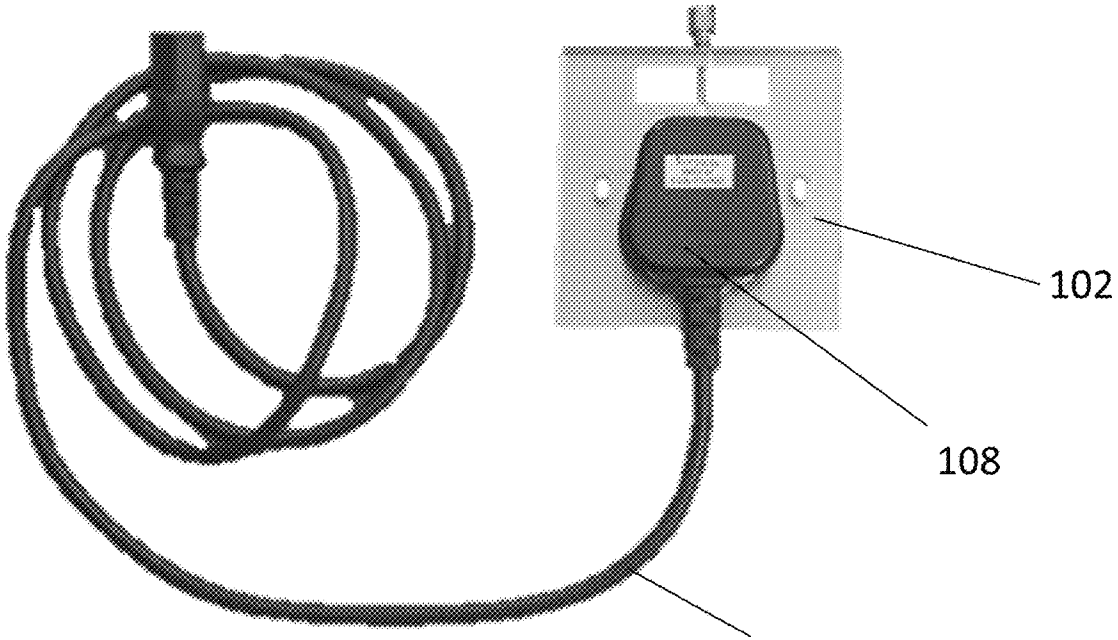
Figure 10C:
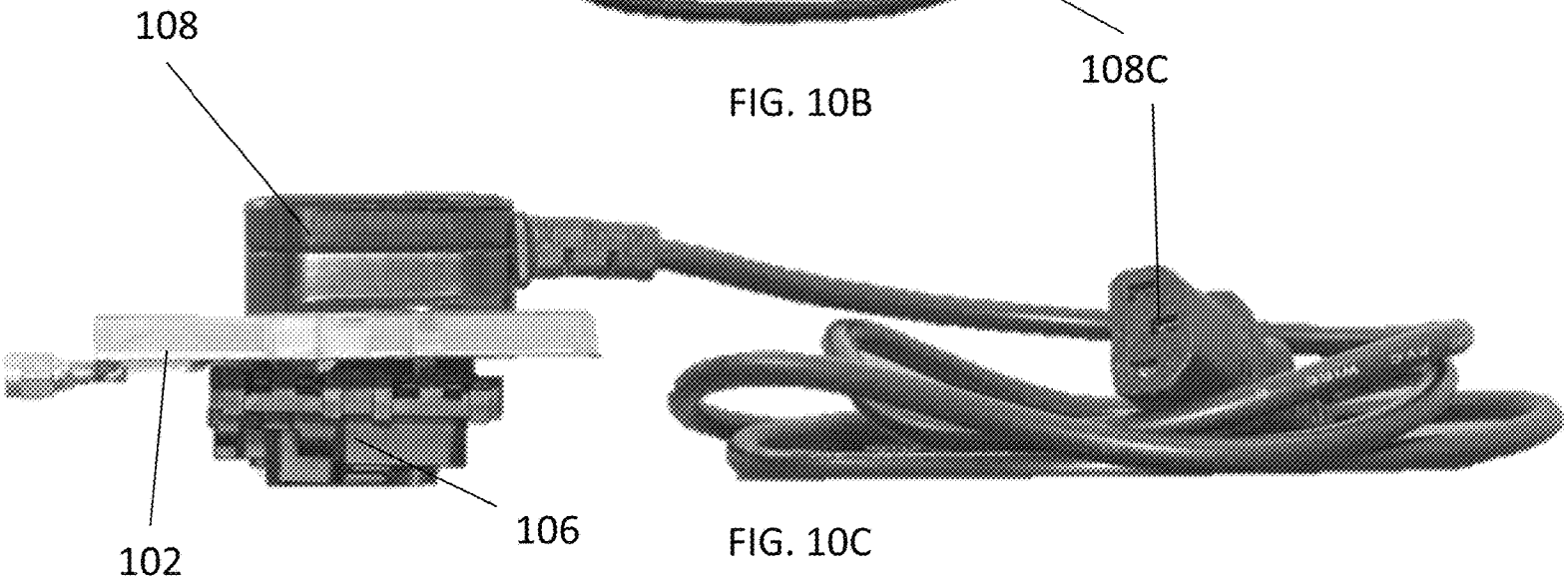

With reference to FIG. 8, the plot shows the measured antenna efficiencies of the panel and socket panel. The panel has a maximum and minimum efficiency of 80.7% and 71.4% in the measured impedance passband (2.35-2.54 GHz), respectively. In the socket panel, the antenna efficiency varies between 77.1% and 65.8% in the measured impedance passband (2.31-2.52 GHz).

The inventors also considered some example scenarios that the socket panel may be physically connected with an electrical plug with reference to the configurations illustrated in FIGS. 3A to 3B. In the simulation experiment, the plug is modeled according to an example electrical power plug 108 with the wires and fuse inside referring to FIGS. 2A and 2B, and the parameters of the panel and power supply box are kept the same as those in the previous examples. With reference to FIGS. 9A to 9C and 10A to 10C, the example configurations of the antenna-integrated socket panel 100 combined with a plug 108 or a plug 108 and connection cable 108C are shown respectively.

Figure 11:
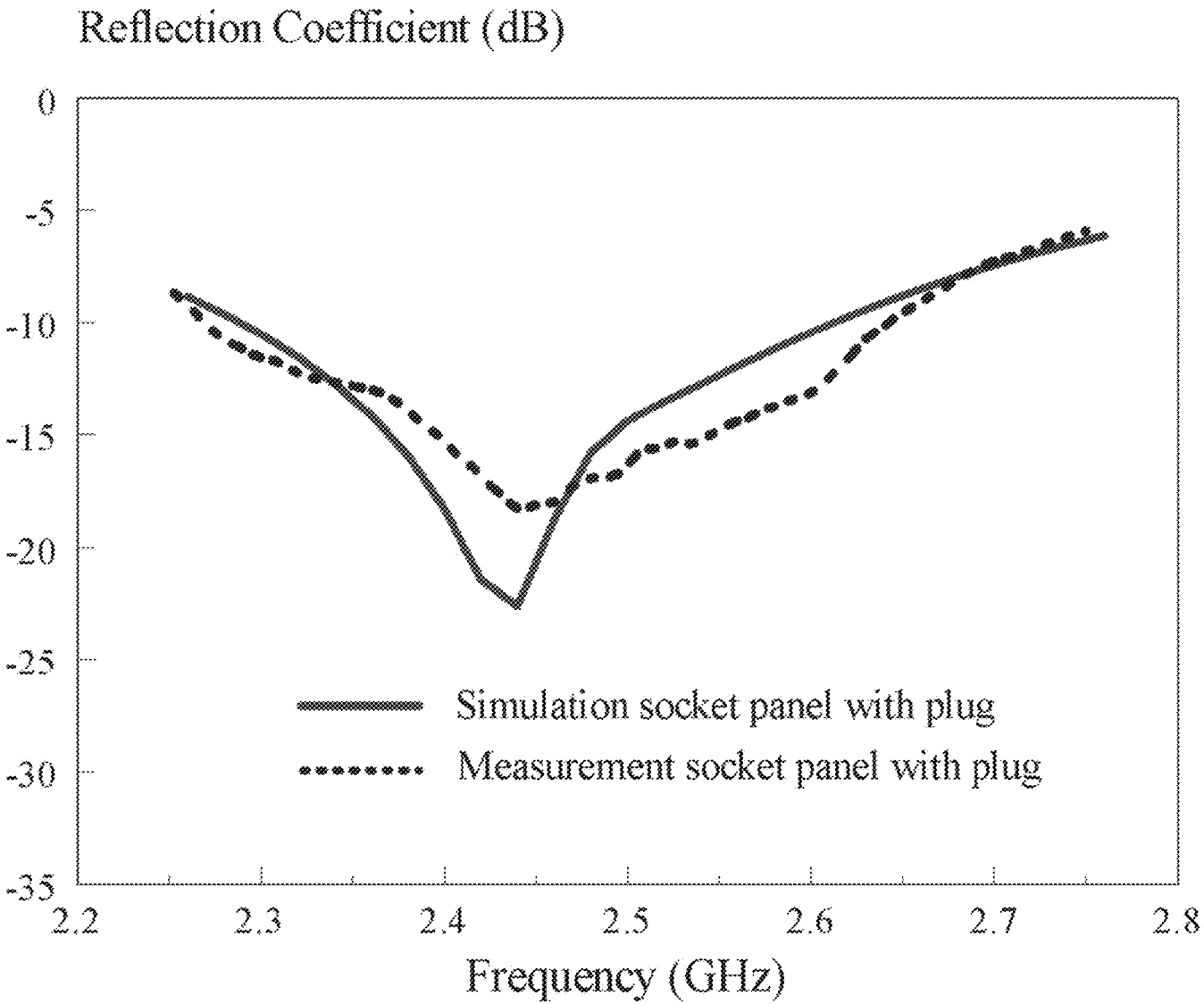
FIG. 11 is a plot showing simulated and measured reflection coefficients of the combination of the electrical connector and the antenna assembly of FIG. 9B.

With reference to FIG. 11, there is provided the results of the simulated and measured reflection coefficients of the socket panel with plug. Reasonable agreement is observed between the simulated and measured results. Both simulated and measured resonant frequency is 2.44 GHz. Impedance bandwidths of 13.1% (2.29-2.61 GHz) and 15.1% (2.27-2.64 GHz) are obtained in the simulation and measurement, respectively. The bandwidths are sufficient to cover the designed WLAN band (3.3%). It can be found that the socket panel with plug has broader impedance bandwidth than that without plug. That could be due to the losses introduced by the plug.

Figure 12:
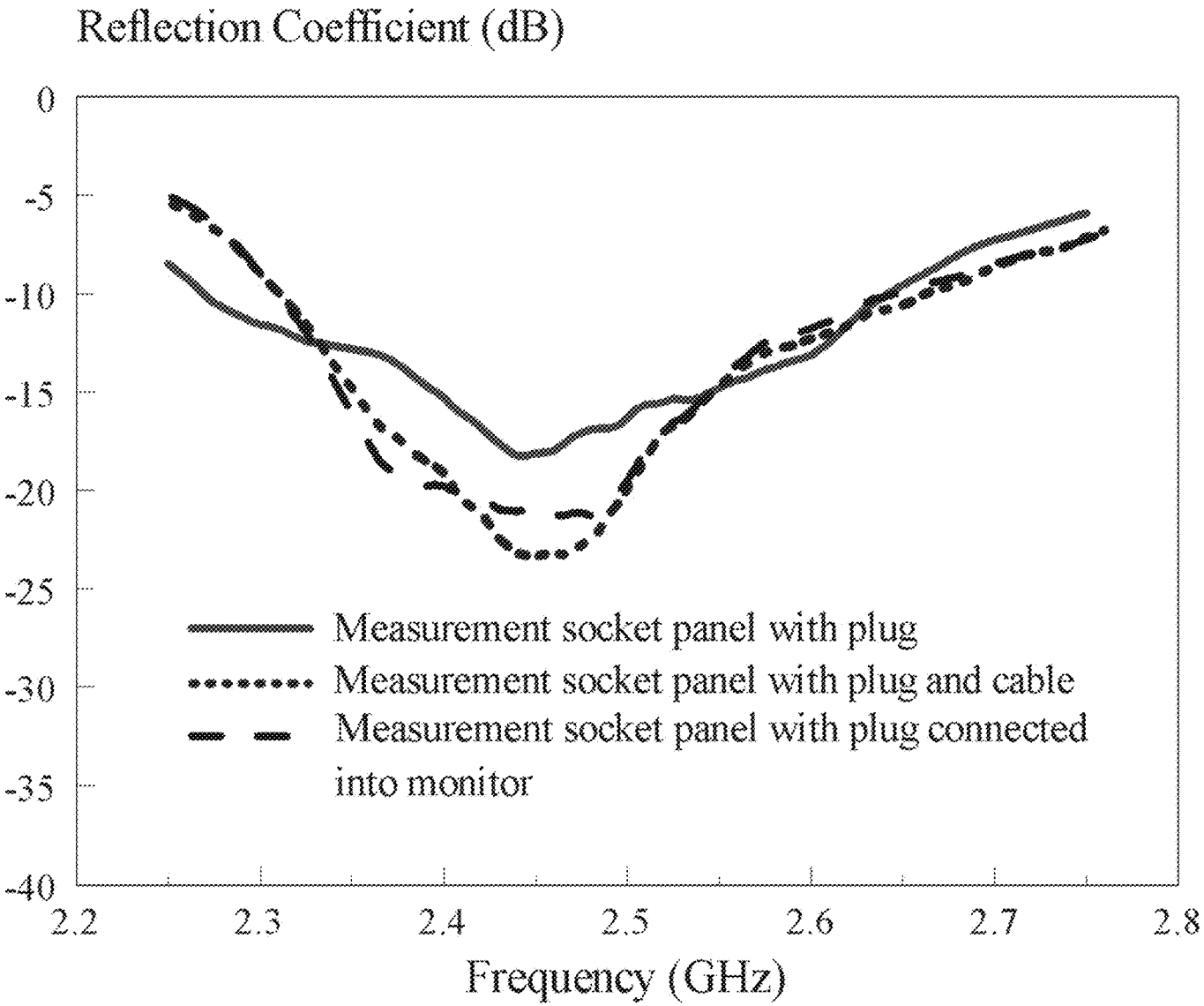
FIG. 12 is a plot showing measured reflection coefficients of the antenna assembly of FIG. 1A, in electrical connection with an electrical plug, an electrical plug connected with a connection cable, and a plug with a cable further connected to an external electrical apparatus.

For comparison, the measured reflection coefficients of socket panel with plug in three different situations are shown in FIG. 12, which are the socket panel with plug, socket panel with plug and connection cable, and socket panel with plug and cable connected into a computer monitor. The socket panel with plug and connection cable has a measured resonant frequency of 2.45 GHz. The resonant frequency shifts to 2.47 GHz if the cable is connected to a monitor. These two cases have measured impedance bandwidths of 13.65% (2.32-2.66 GHz) and 13.71% (2.31-2.65 GHz), respectively, which are still sufficient enough to cover the designed frequency band (3.3%). No virtual effect was observed on the reflection coefficient, when the cable is connected a monitor. Besides, when compared with the result of the socket panel with plug, no significant difference is shown in the reflection coefficient of the socket panel with plug and connection cable.

Figures 13A, 13B:
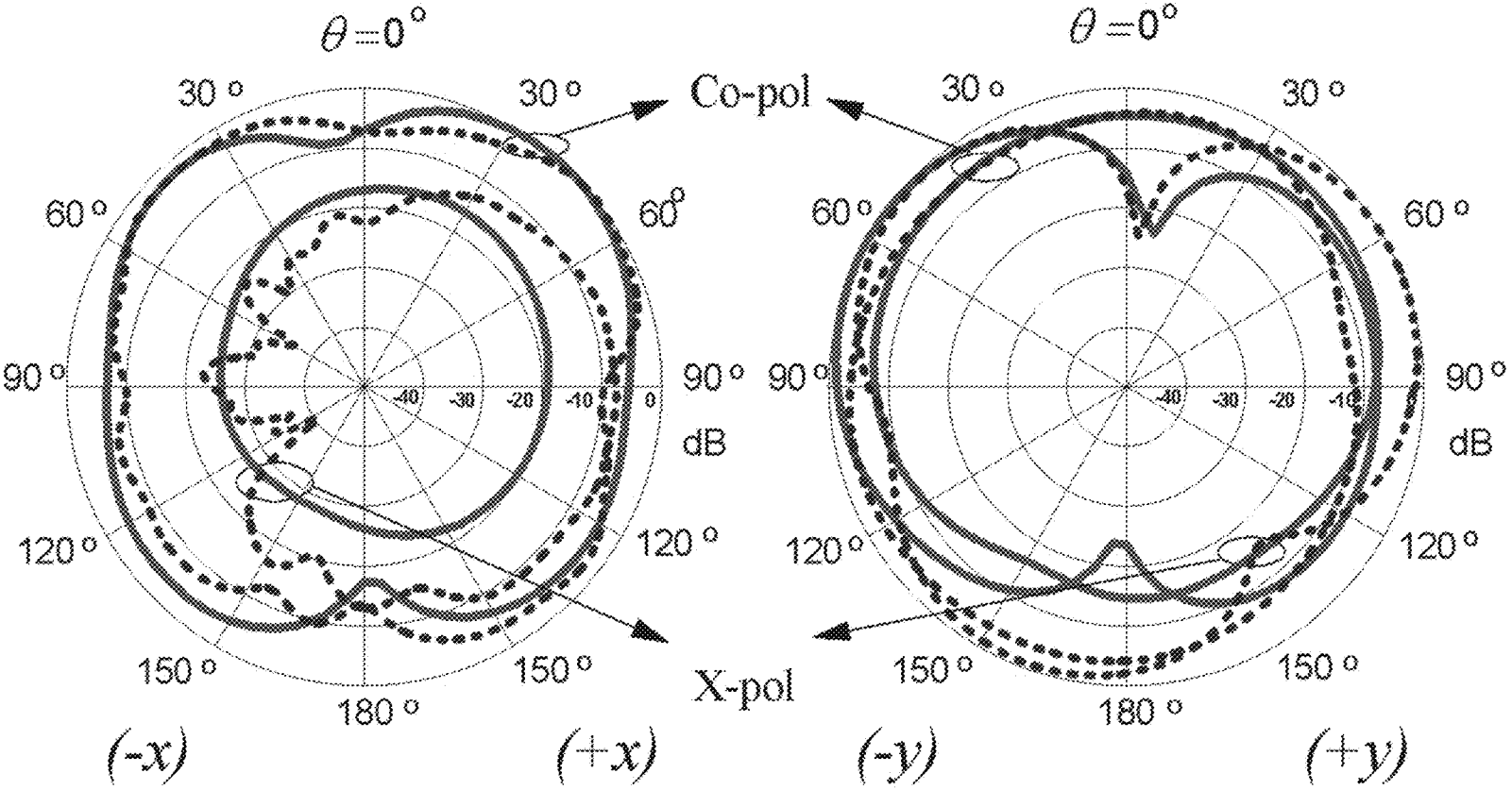
FIGS. 13A and 13B are plots showing simulated and measured radiation patterns of the antenna assembly of FIG. 9B in an elevation x-z plane and in an elevation y-z plane respectively.

Referring to FIGS. 13A and 13B, there is shown simulated and measured radiation patterns of the antenna-integrated socket panel with plug at 2.4 GHz. The measured results reasonably agree with the simulated ones. It can be seen that the shape of radiation patterns in xz-plane resemble the counterpart in the socket panel without plug. The simulated and measured maximum gain directions are at $\phi=0°$, $\theta=35°$ and $\phi=0°$, $\theta=49°$, respectively. It can be found that the maximum gain directions are the same as those of the socket panel without plug.

Figures 13C, 13D:
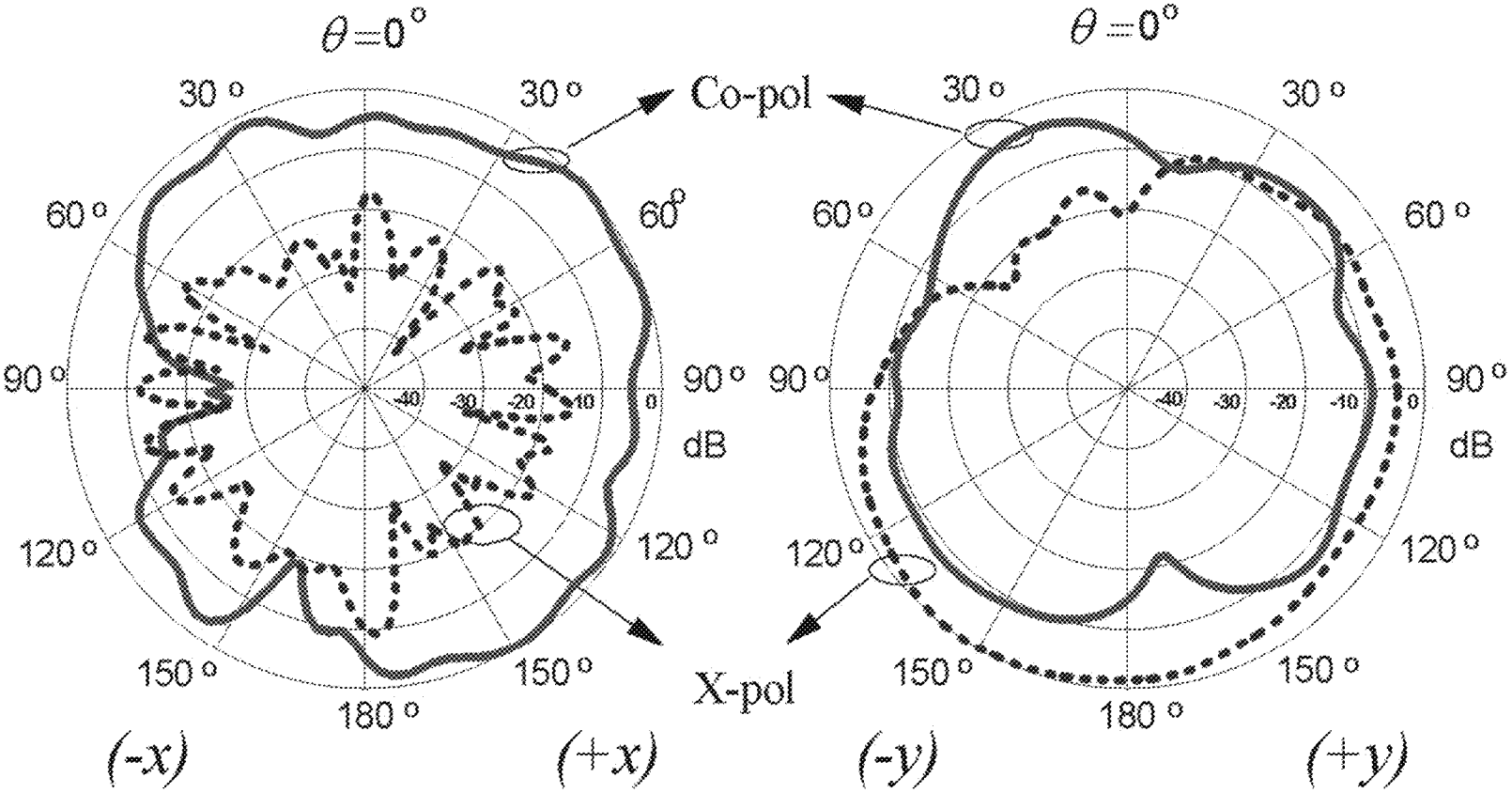
FIGS. 13C and 13D are plots showing measured radiation patterns of the antenna assembly of FIG. 10B in an elevation x-z plane and in an elevation y-z plane respectively.

Referring to FIGS. 13C and 13D, there is shown measured radiation patterns of socket panel with plug and connection cable at 2.4 GHz. Compared with patterns of socket panel with plug as shown in FIGS. 13A and 13B, the patterns have similar shapes but with ripples caused by the cable. However, due to multipath effects in indoor communication environment, the requirement for radiation patterns can be relaxed.

Figure 14:
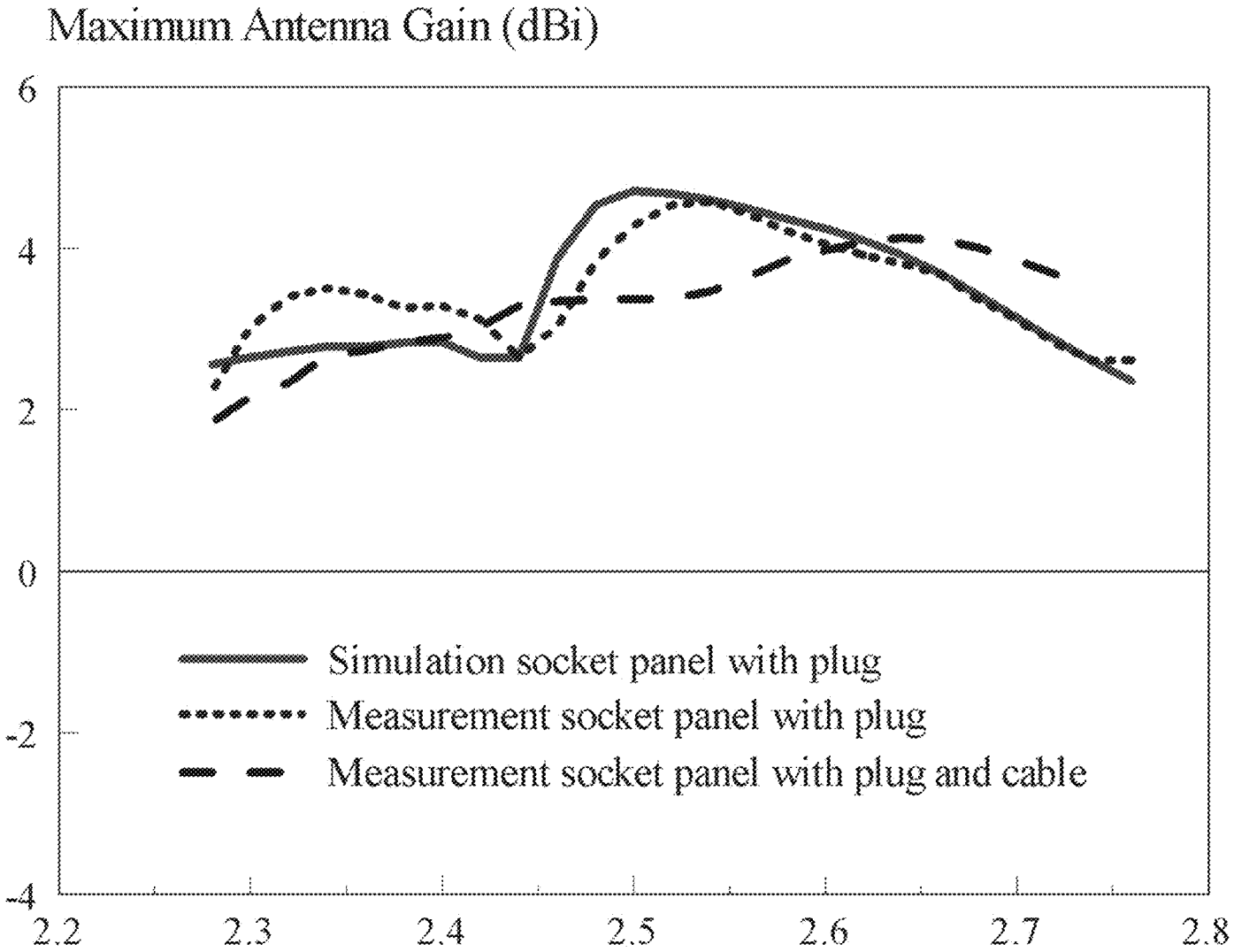
FIG. 14 is a plot showing simulated and measured maximum gains of the antenna assembly of FIG. 9B and measured maximum gains of the antenna assembly of FIG. 10B.

With reference to FIG. 14, there is shown simulated and measured maximum gains of the socket panel with plug against frequency. Over the respective impedance passband, the simulated and measured peak values are 4.72 dBi and 4.58 dBi. The maximum antenna gain of the socket panel with plug and connection cable is also given in FIG. 14 for comparison. In the measured impedance passband (2.32-2.66 GHz), it has a peak value of 4.14 dBi. It can be observed that the antenna gain is degraded when compared with the result of socket panel with plug. This is reasonable because the long cable introduces losses.

Figure 15:
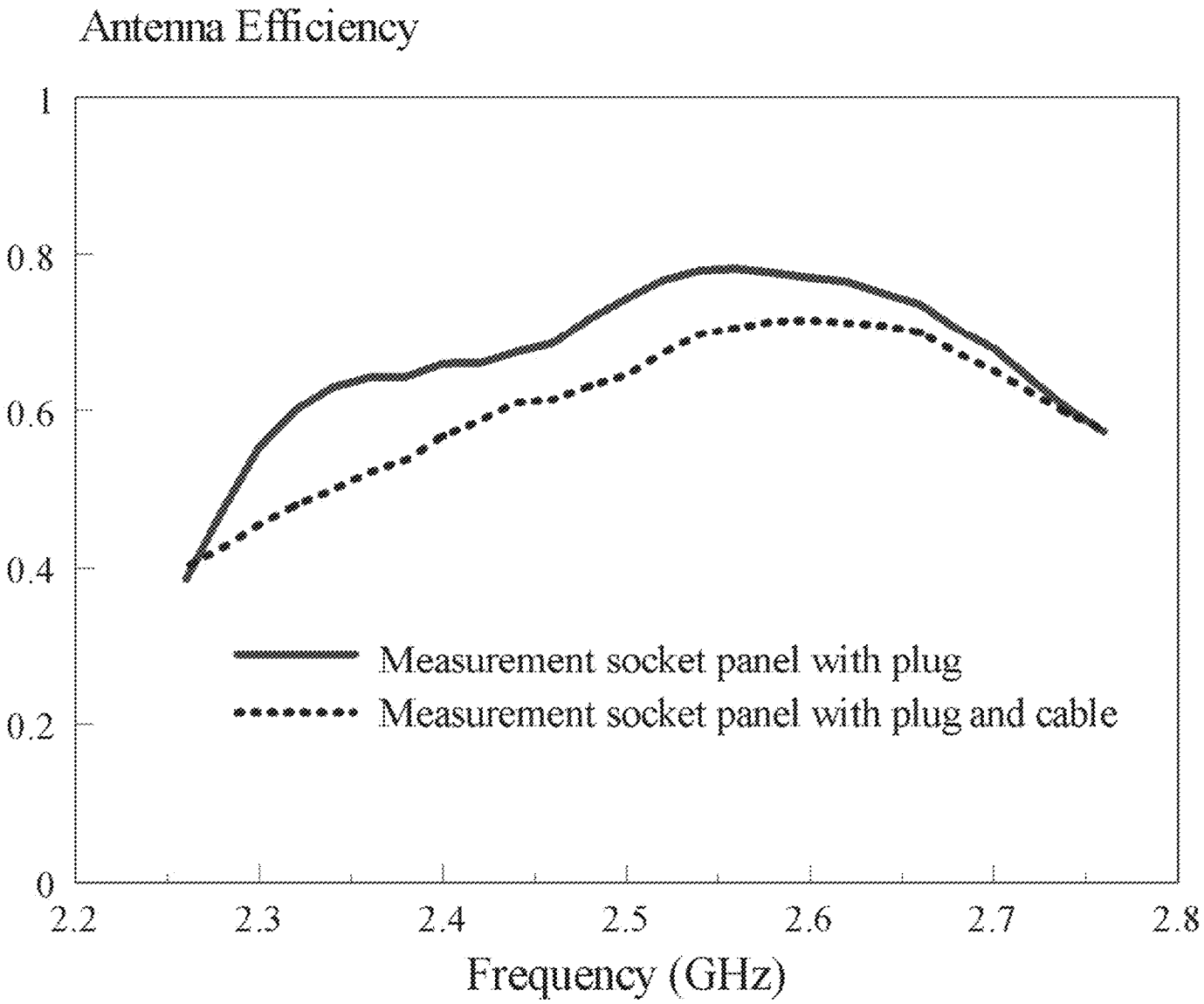
FIG. 15 is a plot showing measured antenna efficiencies of the antenna assembly of FIG. 9B and the antenna assembly of FIG. 10B.

With reference to FIG. 15, the plots show measured antenna efficiencies of the socket panel with plug and the one with plug and connection cable. In the measured impedance passband (2.27-2.64 GHz), the socket panel with plug has a maximum and minimum efficiency of 78.2% and 42.9%, respectively. It varies between 66.0% and 71.8% in the designed 2.4 GHz-WLAN band (2.4-2.48 GHz). As comparison, the socket panel with plug and connection cable has a maximum value of 71.6% and a minimum value of 48% over the measured impedance passband (2.32-2.66 GHz). Across the designed 2.4 GHz-WLAN band (2.4-2.48 GHz), the measured efficiency changes between 63.2% and 56.8%. As expected, the socket panel with plug and connection cable has lower antenna efficiency than the one without cable, due to the losses caused by the long cable. It is consistent with the result of antenna gain in FIG. 14.

These embodiments may be advantageous in that the antenna assembly may be used as a dual-function antenna which may also operate as a socket panel and an antenna for wireless communication. It may be designed with a dimension according to the some existing socket panel in the market, but the antenna body may be made of zirconia material for its transparency.

Through the parametric studies, it was found that the DR height and slot length may be fine-tuned for different purposes or requirements, and these parameters may be used to determine the operating frequency band and adjust impedance bandwidth, respectively.

A slight asymmetry also shows in the radiation patterns, resulting from the off-center located feeding slot. Advantageously, the socket panel may be used in household or office environment, as the requirement for radiation patterns may be relaxed in indoor communication, e.g. due to multipath effects in indoor communication environment.

In addition, the antenna assembly is transparent, therefore may be used in functional modules including indicators or illuminations. For example, the socket panel may be designed to illuminate a dimmed light through the transparent DR block and may be used as a night lamp in when the in-room lighting is switched off.

Advantageously, antennas in accordance with these embodiments may be incorporated into practical home appliance. For example, an electrical socket panel can be used as dielectric antennas. Such technique can be used to camouflage antennas by turning them into home appliance such as a socket panel, a ceiling mounted light, etc.

In some indoor environments, for example in buildings or premises for home/office use, power socket panels are usually deployed in every part of the premises. Therefore, antenna assemblies that incorporate the function of power sockets may be used to facilitate both the electricity usage requirement as well as wireless communication purposes. The socket antenna units may form a mesh network that covers the entire building or at least a predetermined home/office area, such that smart/intelligent home or office environment may be easily implemented using the functional module provided in each of these socket antenna units.

By integrating other types of functional circuits or modules, the antenna assembly may be used in other intelligent home or office appliance. For example, the antenna assembly may be embedded in the socket panels for controlling curtains, doors, TV, light in a room. The transparent material may make the appearance of wireless systems aesthetic and attractive. For example, the electrical power supply of the switch panel may be wirelessly switched on/off using a mobile application in some example smart home applications.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. An antenna assembly comprising an a dielectric resonator antenna including a dielectric resonator antenna body and a slot feeder, and at least one functional module arranged to operate with a function different from that provided by the dielectric resonator antenna; wherein the at least one functional module includes at least one electrical power socket arranged to connect with an external electrical connector;

wherein each of the at least one electrical power socket comprises a plurality of apertures defined on the dielectric resonator antenna body arranged to receive a plurality of matching electrical pins of an electrical plug such that the electrical plug and the electrical power socket are securely held together when the electrical pins are inserted in the electrical power socket; wherein the electrical power socket is arranged to supply electrical power to an electrical apparatus via the electrical plug inserted in the electrical power socket, and the dielectric resonator antenna is operable to radiate a communication signal to an external communication device.

2. The antenna assembly in accordance with claim 1, wherein the dielectric resonator antenna is a dielectric resonator loaded slot antenna.

3. The antenna assembly in accordance with claim 1, wherein the dielectric resonator antenna is arranged to radiate an electromagnetic radiation including at least one of a broadside, an endfire, an omnidirectional and a conical-beam radiation pattern.

4. The antenna assembly in accordance with claim 1, wherein the dielectric resonator antenna includes a non-resonant-type antenna.

5. The antenna assembly in accordance with claim 1, wherein the functional module is physically connected to the dielectric resonator antenna body.

6. The antenna assembly in accordance with claim 5, wherein the dielectric resonator antenna body is provided with at least one mounting structure arranged to mount the functional module thereon.

7. The antenna assembly in accordance with claim 6, wherein the mounting structure is further arranged to at least partially accommodate or encompass the functional module.

8. The antenna assembly in accordance with claim 6, wherein the mounting structure includes a cavity defined in the dielectric resonator antenna body.

9. The antenna assembly in accordance with claim 1, wherein the dielectric resonator antenna body is a rectangular block of dielectric material.

10. The antenna assembly in accordance with claim 9, wherein the dielectric material includes at least one of zirconia, silicon dioxide, acrylic and porcelain.

11. The antenna assembly in accordance with claim 1, wherein the dielectric resonator antenna body is at least partially transparent.

12. The antenna assembly in accordance with claim 1, wherein the slot feeder comprises a feeding slot structure defined on the dielectric resonator antenna body.

13. The antenna assembly in accordance with claim 12, wherein the feeding slot structure is defined in a positioned shifted from a center position of the dielectric resonator antenna body.

14. The antenna assembly in accordance with claim 12, wherein the slot feeder further comprises a microstripline or coaxial feedline adjacent to the feeding slot structure.

15. The antenna assembly in accordance with claim 1, wherein the slot feeder includes at least one of a probe feed, a direct microstrip feedline, a coplanar feed, a dielectric image guide, a metallic waveguides and a substrate-integrated waveguide.

16. The antenna assembly in accordance with claim 1, wherein the dielectric resonator antenna further comprises a ground plane adjacent to the dielectric resonator antenna body.

17. The antenna assembly in accordance with claim 16, wherein the ground plane includes an electrical conductive sheet connected to the dielectric resonator antenna body.

18. The antenna assembly in accordance with claim 17, wherein the electrical conductive sheet includes a sheet of copper adhesive.

19. The antenna assembly in accordance with claim 1, wherein the antenna assembly is arranged to operate as an electrical socket panel.

20. The antenna assembly in accordance with claim 1, wherein the functional module comprises an electrical switch.

21. The antenna assembly in accordance with claim 20, wherein the antenna assembly is arranged to operate as an electrical switch-socket panel.

22. The antenna assembly in accordance with claim 1, wherein the dielectric resonator antenna body is arranged to form a part of an electrical apparatus.

23. The antenna assembly in accordance with claim 22, wherein the electrical apparatus includes an intelligent home or office appliance.

24. The antenna assembly in accordance with claim 22, wherein the electrical apparatus includes a wireless-communication-enabled device.

25. A wireless-communication-enabled device, comprising an antenna assembly in accordance with claim 1, wherein the dielectric resonator antenna is arranged to facilitate a communication between the external communication device and the wireless-communication-enabled device.

26. An intelligent home or office appliance, comprising the wireless-communication-enabled device in accordance with claim 25 or the antenna assembly in accordance with claim 1.

* * * * *